US005224542A

United States Patent [19]

Hemsath

[11] Patent Number: 5,224,542

[45] Date of Patent: Jul. 6, 1993

[54] GAS FIRED RADIANT TUBE HEATER

[75] Inventor: Klaus H. Hemsath, Toledo, Ohio

[73] Assignee: Indugas, Inc., Toledo, Ohio

[21] Appl. No.: 817,158

[22] Filed: Jan. 6, 1992

Related U.S. Application Data

[60] Continuation-in-part of Ser. No. 636,777, Jan. 2, 1991, Pat. No. 5,082,055, which is a division of Ser. No. 469,173, Jan. 24, 1990, Pat. No. 5,020,596.

[51] Int. Cl.[5] ..... E21B 43/24

[52] U.S. Cl. ..... 166/272; 166/302; 126/91 A; 165/904; 431/328; 431/352

[58] Field of Search ..... 166/261, 272, 302, 303; 165/901, 904; 431/328, 352, 353; 126/91 A, 92 C; D26/114; 422/204

[56] References Cited

U.S. PATENT DOCUMENTS

| | | | |
|---|---|---|---|
| 1,494,499 | 5/1924 | O'Dowd | 126/92 C |
| 2,902,270 | 9/1959 | Salomonsson et al. | 166/59 |
| 2,960,983 | 11/1960 | Goss | 126/91 A |
| 3,113,623 | 12/1963 | Krueger | 166/59 |
| 3,181,613 | 5/1965 | Krueger | 126/91 A |
| 3,244,231 | 4/1966 | Grekel et al. | 166/59 |
| 3,688,760 | 9/1972 | Rudin | 126/91 A |
| 3,908,628 | 9/1975 | Lazaridis et al. | 126/91 A |
| 3,946,719 | 3/1976 | Bark et al. | 126/91 |
| 4,085,803 | 4/1978 | Butler | 166/303 |
| 4,127,169 | 11/1978 | Tubin et al. | 166/250 |
| 4,172,445 | 10/1979 | Sellers | 126/343.5 A |
| 4,322,603 | 3/1982 | Bright | 219/278 |
| 4,336,839 | 6/1982 | Wagner et al. | 166/59 |
| 4,378,846 | 4/1983 | Brock | 166/303 |
| 4,397,356 | 8/1983 | Retallick | 166/303 |
| 4,442,898 | 4/1984 | Wyatt | 166/303 |
| 4,463,803 | 8/1984 | Wyatt | 166/59 |
| 4,493,309 | 1/1985 | Wedge et al. | 431/116 |
| 4,519,770 | 5/1985 | Kesselring et al. | 431/328 X |
| 4,678,039 | 7/1987 | Rivas et al. | 166/303 |
| 4,809,672 | 5/1989 | Kendall et al. | 126/91 A |
| 5,020,596 | 6/1991 | Hemsath | 166/272 |
| 5,082,055 | 1/1992 | Hemsath | 166/272 |

FOREIGN PATENT DOCUMENTS

| | | | |
|---|---|---|---|
| 221206 | 5/1962 | Austria | 126/91 A |
| 317406 | 1/1991 | Japan | 126/91 A |

*Primary Examiner*—Ramon S. Britts
*Assistant Examiner*—Roger J. Schoeppel
*Attorney, Agent, or Firm*—Body, Vickers & Daniels

[57] ABSTRACT

A radiant tube heater is provided for a gas fired burner which fires heated products of combustion into an inner longitudinally-extending tube which is concentrically pinned to an outer longitudinally-extending tube which in turn is concentrically mounted within a heat transfer, tube which radiates heat to work. The outer and inner transfer tubes have closed axial ends opposite the burner and the inner tube is radially spaced closely adjacent the outer tube to define an annular heat transfer passage therebetween. A specific hole size pattern in the inner and outer tubes in combination with the radial distance of the heat transfer passage insure long path gas flow lengths which promote laminar flow and even heat distribution along the length thereof thus producing a radiant tube which radiates heat uniformly from the heat transfer tube to the work along its length.

24 Claims, 4 Drawing Sheets

GAS FIRED RADIANT TUBE HEATER

This invention is a continuation-in-part of my prior application Ser. No. 636,777 filed Jan. 2, 1991 (now U.S. Pat. No. 5,082,055 (which in turn is a divisional application of Ser. No. 469,173 filed Jan. 24, 1990 (now U.S. Pat. No. 5,020,596).

This invention relates to a gas fired, radiant tube heater apparatus, per se, and in combination therewith a system, or process for generating uniform heat flux. The invention is particularly applicable to a gas fired radiant tube heater for use as a down hole heater in the oil recovery art and the invention will be described specifically with respect thereto. However, the invention is clearly not to be limited to its down hole heater application and has specific application as a radiant tube heater in the industrial heat treat furnaces.

BACKGROUND

Because of the small sizing of the casing or bore diameter of injection and production oil recovery wells, down hole heaters, if used, have heretofore relied on electrical heating elements inserted into the casing. Whether the heating elements be resistance heating elements or induction heating elements, the power generating equipment must be capable of generating high heat fluxes. The space limitations within the casing make it difficult to position and size electrical heating elements which can generate high heat flux uniformly along the casing lengths. In fact, the heating elements gradually heat the steam or water travelling along the length of the elements to higher and higher temperatures until steam is formed at the discharge point. Thus, down hole heaters use excessive amounts of electricity to generate high heating fluxes in applications where heating progresses to the highest temperature coincident with the discharge point of the steam from the heater. Those types of heaters are clearly inapplicable to the oil recovery system claimed in the U.S. Pat. No. 5,020,596 grandparent patent or to any other recovery scheme where a uniform heat flux is required over a length portion of the heater.

Fuel fired burners are, from an energy cost analysis, less expensive than electrical heating arrangements. However, the size of the well casing coupled with the requirement that hot water or steam be generated or boosted at the bottom of the casing while the steam or water flows therethrough has heretofore precluded their application as heaters for recovering materials from subterranean formations.

Radiant tube burners or heaters have long been used in industrial heating applications and have conventionally been powered by electrical heating elements or by fuel fired burners. Electrically heated radiant tubes basically comprise heating elements within a tube which extend into a furnace or work zone. The elements radiate heat to the tube and the tube radiates heat to the work. In high temperature heating applications such as those involving the melting of metals and the like, electrically heated radiant tubes are preferred since the heating elements radiate uniform heat flux to the tube. Again, the cost of electricity in a high temperature flux application dictates that fuel fired burners be used to fire their products of combustion into a tube which in turn will radiate heat to the work. However, fuel fired radiant tube heating applications do not maintain a uniform temperature along the length of the tube especially at high temperatures where radiated heat fluxes are especially significant when considering heat transfers from burner to work. In such application, the adiabatic temperatures produced by the fuel fired burner cause a hot spot whereat the heat flux intensity is greater than that at other areas of the burner. Numerous schemes have been tried to arrive at uniform distribution heat patterns, especially at high temperatures from fuel fired burners. These have met with varying degrees of success. One such arrangement, funded by Gas Research Institute, uses a tangentially fired burner with products of combustion from the burner entering a slotted baffle arrangement to develop high convective heat transfers in the form of slotted jets. Convective heat transfer from the slotted jet is then used as a "boost" to the radiated heat flux from the tangential burners to heat a mantle to very high temperatures of 2500° F. However, the heat transfer coefficient while enhanced with this arrangement is fundamentally limited by the coefficient attributed to the radiation heat transfer of the tangentially fired burner which is poor.

Also, within the industrial burner art there are numerous fuel fired burner arrangements which, at first glance, might bear some structural resemblance to the fuel fired radiant tube heater of the present invention, but which have entirely different functions and purposes associated with the structure. For example, Bark U.S. Pat. No. 3,946,719 discloses a burner with longitudinally spaced apertures designed to receive combustion air for cooling certain burner parts to prevent thermal breakdown of the burner.

SUMMARY OF THE INVENTION

A.) The Invention of the Parent Application

In accordance with the parent patent, a fuel fired radiant tube burner is provided which includes a generally cylindrical heat transfer tube, a second cylindrical outer tube concentrically disposed within the heat transfer tube and defining a longitudinally-extending annular exhaust gas passageway therebetween and a third cylindrical inner burner tube concentrically disposed within the outer tube and defining a longitudinally-extending annular heat distribution passageway therebetween. A burner within the inner tube ignites, combusts and burns a source of fuel and air to form heated products of combustion within the burner tube. All tubes are closed by a plate at one axial end thereof while a plate at the opposite axial end of the outer tube and inner tube make heat distribution passageway a closed passageway. Apertures and openings are provided relative to the heat distribution passageway in a preferred orientation such that the heat transfer tube is uniformly heated along its length. More specifically, the apertures and openings are sized and positioned and the tube diameters selected to develop a substantially laminar flow of the products of combustion from the burner within the heat distribution passageway which modifies the radiation flux emanating from the burner such that the radiation heat flux transmitted from the outer tube is effective to uniformly heat the heat transfer tube along its length.

In accordance with a more specific feature of the parent invention, a plurality of apertures extend through the inner tube at spaced increments which spacing longitudinally decreases in the direction of the end plate which is spaced away from the burner. Similarly, the outer tube has a plurality of spaced openings which likewise decrease in the longitudinal direction towards the end plate so that a greater mass of the products of combustion enter and exit the annular heat distribution passageway at positions closer to the end plate and spaced away from the burner. Importantly, the radial distance between the heat transfer tube and the heat tube is maintained at a very small distance and the circumferential and longitudinal distances between apertures and openings are spaced at relatively long distances relative to the size of the opening to establish relatively long flow paths for the products of combustion which flow at a Reynolds number sufficient to establish laminar flow conditions within the heat distribution passageways. The laminar flow conditions for closely spaced plates establish high convective heat transfer fluxes which modify the heat radiation flux emanating from the burner to balance the hot spots which would otherwise occur by radiation from the burner within the burner tube.

B.) The Present Invention

In accordance with the present invention a radiant tube burner is provided which includes a burner arrangement for firing products of combustion into a generally cylindrical inner tube having two open ends and a plurality of spaced apertures radially extending therethrough. A concentric, closed end outer tube circumscribes the inner tube at a close radial distance to define a longitudinally-extending, small annular heat transfer passageway therebetween and the outer tube has a plurality of spaced openings which radially extend therethrough. A heat transfer tube having closed axial ends is concentrically disposed about the inner and outer tubes and receives heat from the outer tube and also forms a second, larger longitudinally-extending annulus between the heat transfer tube and the outer tube. The apertures and the openings are spaced with respect to each other so as to result in the longest distances between the apertures in the inner tube and the openings in the outer tube for any equidistant aperture and opening pattern. The apertures, the openings and the radial distance between the heat transfer tube and the burner tube are spaced and sized so that the heat transfer tube is uniformly heated by the combined action of the outer and inner tube when hot burner combustion products are forced to flow from the burner through the inner and outer tubes, through the annular space between the inner and outer tubes, and through the annular space between the outer tube and the heat transfer tube before the they are returned from the outer annulus to exhaust in the outer heat transfer tube.

In accordance with a more specific feature of the invention, the openings in the outer tube are smaller in diameter than the diameter of the apertures in the inner tube. Preferably, the diameter of the apertures are at least three times greater than the diameter of the openings. Still more specifically, the openings are arranged in a honeycomb pattern extending about the outer tube and the honeycomb pattern regularly repeats itself along the length of the outer tube. The apertures are arranged in a diamond shaped array extending about the inner tube and the diamond shaped array regularly repeats itself along the length of the inner tube. Importantly, each hole which is at a point in the diamond array is centered in the middle of the overlying honeycombed pattern, and thus the hole arrangement of the invention can be easily produced in simple machining operations since all apertures and all openings are constantly sized.

In accordance with another aspect of the invention the inner tube has a burner axial end and a tube axial end and the outer tube has a burner axial end and a tube axial end and the tube axial end of the inner tube extends longitudinally a distance not greater than the longitudinal distance of the tube axial end of the outer tube. A plate closes the tube axial end of the outer tube so that an annular opening between the inner tube and the outer tube is open adjacent the burner axial ends of the inner and outer tube for maintaining pressure at the burner axial ends causing the burner products of combustion to uniformly exit the openings along the length of the outer tube.

In accordance with another aspect of the invention the outer tube has an axial end adjacent the air manifold, a burner tube within the air manifold, means to supply a gaseous fuel to the burner tube and means to supply primary combustion air from the air manifold to the burner tube and means to ignite the primary air and the gaseous fuel within the burner tube. An arrangement associated with the air manifold is provided to supply secondary combustion air downstream of the burner tube to assure combustion of the fuel exiting the burner tube. More specifically the air manifold arrangement includes the air manifold having a closed annular end plate seated at and around the burner tube and the annular end plate has a plurality of secondary air openings circumferentially spaced about the annular end plate for directing jet streams of secondary air through the annual air openings.

In accordance with the general inventive concept, a fuel fired radiant tube burner is provided which includes a first generally cylindrical heat transfer tube; a second cylindrical outer tube concentrically disposed within the heat transfer tube and defining a longitudinally-extending annular exhaust gas passageway therebetween and a third inner tube is concentrically disposed within the outer tube and defines a longitudinally-extending annular heat transfer passage therebetween. A burner arrangement is provided to fire its products of combustion into the outer tube and a plate mechanism is provided for closing the first and second axial tube end openings which are adjacent one another. An aperture arrangement associated with the inner tube and an opening arrangement associated with the outer tube overlie one another in a pattern which produces long distances therebetween whereby the heat transfer tube is uniformly heated along its length.

It is thus a principal object of the present invention to provide an improved gas fired, radiant tube heater.

In accordance with another object of the invention, an improved radiant tube burner is provided which can be used in long lengths as a small diameter cylindrical down hole burner.

In accordance with still another object of the invention, a fuel fired radiant tube burner is provided which maintains a relatively uniform radiation heat flux over its length.

In accordance with still another object of the invention, a fuel fired radiant heat tube is provided which maintains an even temperature distribution about its length at high elevated temperatures in excess of 2,000° F.

In accordance with still another object of the invention, a fuel fired radiant tube burner is provided which generates uniform heat fluxes over a very wide operating range and over very large heat exchange areas.

In accordance with still yet another feature of the invention, a fuel fired radiant tube burner is provided which can generate heat fluxes in excess of 25,000 BTU/hr-ft$^2$.

It is yet another object of the invention to provide an inexpensive radiant tube heater which can be used in heat treat furnaces and the like.

It is still yet another object of the invention to provide a gas-fired radiant tube heater which can be applied to heat treat furnaces operated at high temperatures in excess of 2,000° F.

Still yet another object of the invention is to provide a regular, consistently repeating hole pattern in a gas fired radiant tube arrangement which produces uniform radiant heat fluxes along the length of the radiant tube.

A still further object of the invention is to provide an improved burner mechanism for use in a gas fired radiant tube heater.

These and other objects of the present invention will become apparent to those skilled in the art upon a reading of the detailed description of the invention set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF THE PREFERRED EMBODIMENT

Figure 3:
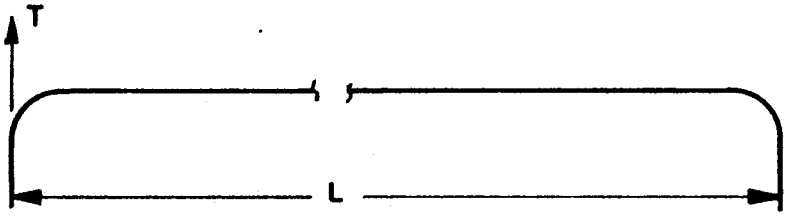
FIG. 3 is a graph indicative of the general heat profile generated along the length of the heater shown in FIG. 3 and corresponds to FIG. 6*a* of the parent application.
Figure 4:
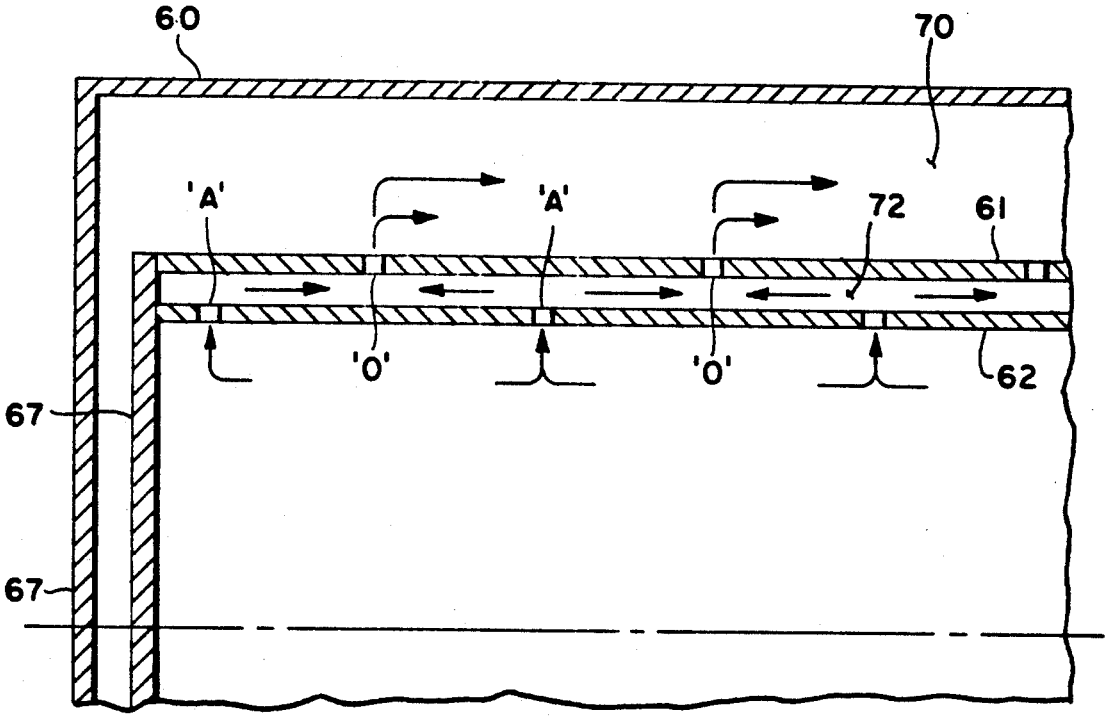
FIG. 4 is an expanded view of a portion of the heater schematically shown in FIG. 3 and corresponds to FIG. 7 of the parent application.
Figure 5:
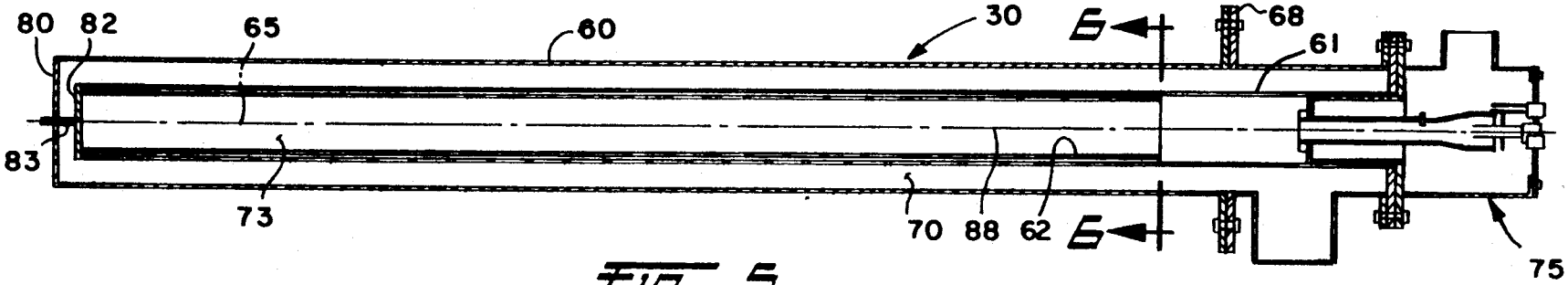
FIG. 5 is a schematic elevation view of the preferred embodiment of the radiant tube of the present invention and is similar to FIG. 2.
Figure 7:
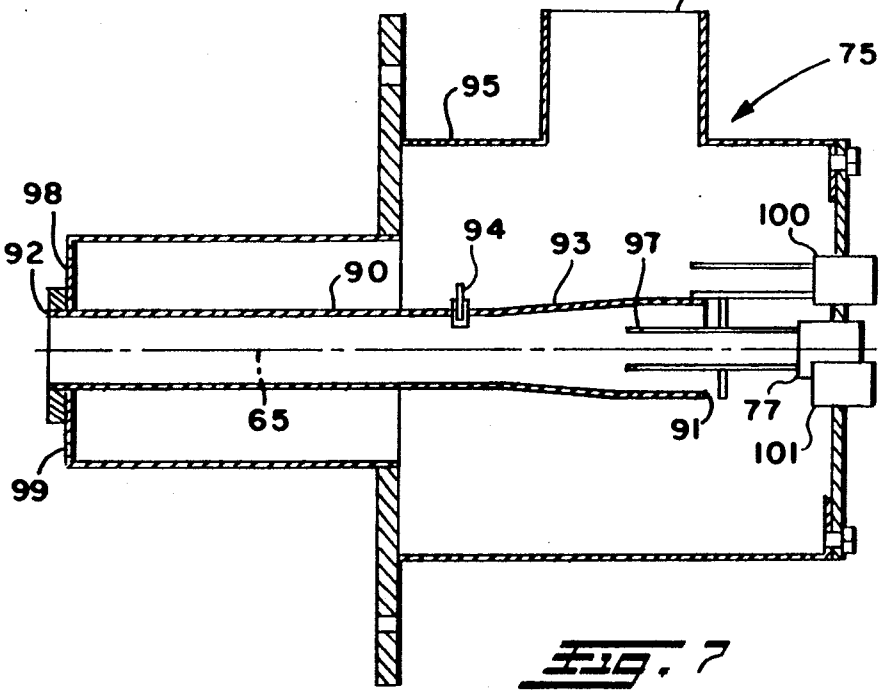
FIG. 7 is a schematic, longitudinally-sectioned view of the burner portion of the radiant tube shown in FIG. 5.
Figure 6:
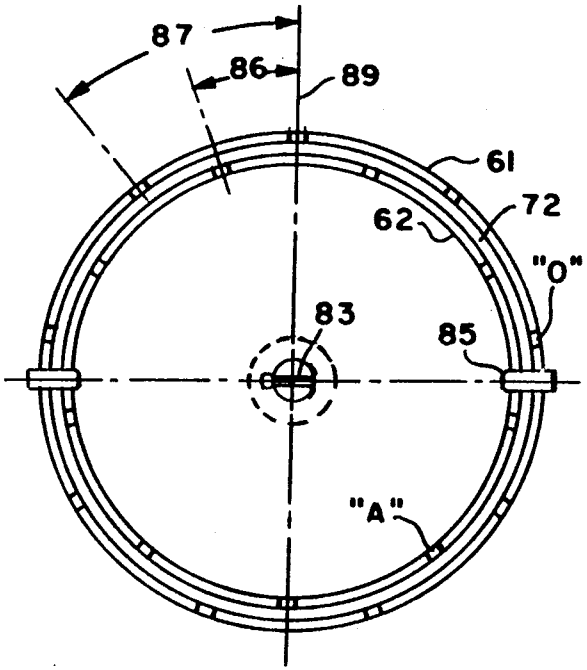
FIG. 6 is a view only of the inner and outer tubes of the preferred embodiment of the present invention taken along lines 6—6 of FIG. 5.

Referring now to the drawings wherein the showings are for the purpose of illustrating an alternative and preferred embodiment of the invention only and not for the purpose of limiting the same, reference is first had to FIGS. 1–4 which correspond to FIGS. 5 through 7 of my parent application when describing the structure and operation of the radiant tube burner of the alternative embodiment shown in FIGS. 1–4, reference numerals used in my parent application will likewise be used in describing the radiant tube heaters shown in FIGS. 1–4 of this invention. At the onset, it is to be noted that basic fundamental concepts or principles shown and described with reference to the radiant tube burner illustrated in FIGS. 1–4 are also applicable to the radiant tube burner illustrated in FIGS. 5–9 of the present invention. Again, reference should be had to my parent application, incorporated herein by reference, to the application of the radiant tube burner as a down hole heater for oil recovery and like purposes. However, it is to be kept specifically in mind that the radiant tube burner is equally applicable, if not more so, to gas-fired radiant tube heater applications in industrial heat treat furnaces and similar applications and especially to those applications operating at high temperatures. In this connection and as will be discussed later on, steel with special alloys to resist thermal stress and strains limit application of gas-fired radiant tube heaters to temperatures of about 2000° F. When heat treated applications require higher temperatures, furnace manufacturers typically supply graphite electric heating elements as the source of radiant heat. This results in an increase in energy costs and in accordance with the present invention, it is contemplated that ceramic or silicon carbide inner and outer tubes will be utilized in the present invention and this will permit a stainless steel heat transfer tube to be utilized as the outer tube.

The principles of an immersion radiant tube heater 30 of the parent invention are schematically illustrated in FIGS. 1, 2, 3 and 4. Immersion radiant heater tube 30 is ideally suited as a down hole heater for oil recovery because it can be constructed as a long length small cylindrical member which can fit within the diameter of an injection bore and it is designed, as explained hereafter, to generate a uniform radiant heat flux substantially along its length making it especially applicable to the oil recovery system disclosed in my parent application. Importantly, very high heat transfer values heretofore not possible in fuel fired burner arrangements are possible also permitting high temperature applications in excess of 2500° F. Thus, immersion radiant tube heater 30 can be applied to many industrial applications other than oil recovery such as might be encountered in certain heat treat processes or in metal melting processes.

Figure 1:
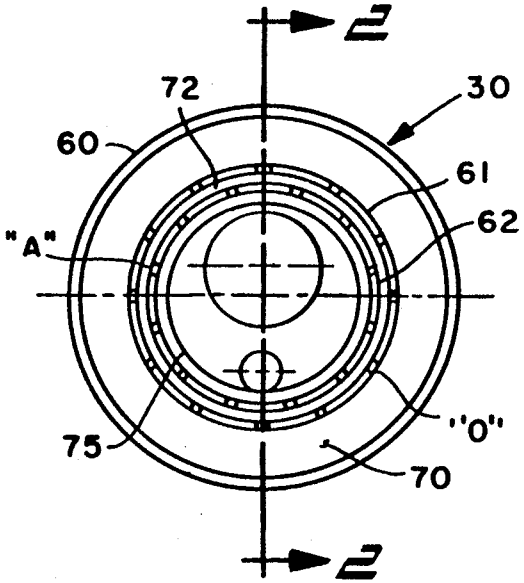
FIG. 1 is a schematic top plan view of the radiant tube burner of my prior invention and corresponds to FIG. 5 of the parent application.
Figure 2:
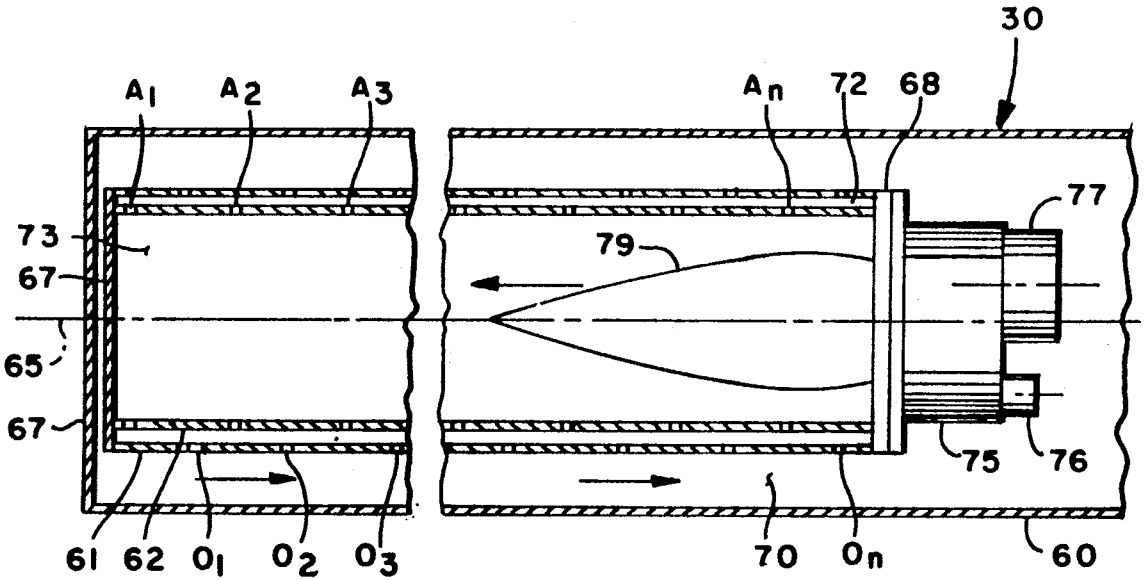
FIG. 2 is a schematic elevation view of the heater of the radiant tube heater of my prior invention taken generally along line 2—2 of FIG. 1 and corresponds to FIG. 6 of the parent application.

As best illustrated in FIGS. 1 and 2, immersion radiant tube heater 30 includes a cylindrical heat transfer tube 60, a cylindrical outer tube 61 concentrically disposed within heat transfer tube 60 and a cylindrical inner tube 62 concentrically disposed within outer tube 62 and all tubes 60, 61, 62 are centered about longitudinal centerline 65. An axial end plate 67 closes one axial end of all tubes 60, 61 and 62. A burner mounting plate 68 closes the opposite axial ends of inner tube 61 and outer tube 62. As thus far defined, heat transfer tube 60 and outer tube 61 define a longitudinally-extending annular exhaust gas passageway 70 therebetween. Exhaust gas passageway 70 is closed at one end by end plate 67 and open at its opposite end for exhausting products of combustion. Inner tube 61 and outer tube 62 define a longitudinally-extending, small annular heat transfer passageway 72 therebetween. As best shown in FIG. 2, heat transfer passageway 72 is closed at its axial ends by axial end plate 67 and burner mounting plate 68. Also, inner tube 62 is closed by axial end plate 67 and burner mounting plate 68 to define a closed cylindrical passage 73.

Mounted to burner mounting plate 68 and centered on centerline 65 is a conventional fuel fired burner 75. Any small diameter industrial fuel fired burner available from sources such as Maxon, Eclipse, North American, etc. with acceptable turndown ratios, i.e. 6:1 to 8:1, are acceptable. Burner 75 conventionally operates by mixing combustion air furnished to the burner through an air line 76 with a combustible gas furnished to the burner through a gas line 77 in a preferred combustible proportion, igniting the same and combusting the mixture to produce products of combustion schematically illustrated by flame front 79 in FIG. 6 within cylindrical passage 73. Conventional controls (not shown) are used to regulate the proportions of fuel and air, i.e. turndown ratio, to vary the heat output from burner 75. When used in the oil recovery system of the parent invention, orifices (not shown) may be provided in air line 76 and gas line 77 to insure the injection of air and gas into burner 75 at the appropriate operating pressures.

Within inner tube 62, there is provided a plurality of apertures designated by the letter "A" in FIGS. 1, 2 and 4. Extending through outer tube 61 there is provided a plurality of openings designated by the letter "O " in FIGS. 1, 2 and 4. The size and number of aperture "A" and opening "O" are predetermined, but for purposes of the alternative embodiment they can be viewed as circular openings of diameter equal to the thickness of the tubes through which they extend and are of constant size (although size could be varied) and of somewhat equal number so that the total number of opening "O" is the same size as and approximately equal to the same number of aperture "A". Opening "O" and aperture "A" are positioned relative to one another in a predetermined manner to define relatively long flow paths. That is, the opening "O" and aperture "A" as shown in FIG. 1 are drilled through the tubes at equally spaced circumferential increments such that an aperture is circumferentially drilled approximately midway between two adjacent openings "O" and visa-versa. In the longitudinal direction as shown in FIG. 2, aperture "A" is drilled in increasingly spaced increments (i.e. designated as $A_1$, $A_2$, $A_3$–$A_n$) from axial end plate 67 to burner plate 68. Similarly, opening "O" is longitudinally spaced to extend an increasing longitudinal distances (from $O_1$, $O_2$, $O_3$,–$O_n$) from axial end plate 67 to burner mounting plate 68. Additionally, aperture "A" is longitudinally spaced to bisect the longitudinal spacing between adjacent opening "O" and visa-versa. Generally speaking, the area within burner tube 62 comprised of aperture "A" and the area within heat transfer tube 61 comprised of opening "O" is greatest at distances furthest removed from burner 75 and the opening area progressively decreases along tube lengths in the direction of burner 75. In addition, the spacing between aperture "A" and opening "O" is offset both in a radial and longitudinal direction from one another to establish flow paths within heat transfer passageway 72 which are relatively long in length.

Conventional fuel fired industrial radiant heat tubes can be basically viewed as a burner positioned at one end of a tube and the burner fires its products of combustion into the tube at one end thereof and recovers the exhausted products of combustion from the opposite end thereof. The products of combustion heat the tube and the tube, in turn, radiates the heat to the work. While there are many variations on the concept and a multitude of burner designs which position or control the combustion process, inherently the tube will be heated intensely at the point where combustion occurs and less intensely thereafter. While the surface temperature measured at any point along the tube length for conventional radiant tube fuel fired designs may be somewhat uniform, the heat flux or the intensity of the heat generated along the length of the tube is a factor raised to the fourth power of the temperature differential and varies dramatically. Accordingly, immersion radiant heat tube 30 will likewise generate a similar hot spot, i.e. the adiabatic temperature of the flame front, which will be transferred by radiation and convection to inner tube 62 at high values relatively close to burner 75 and which will diminish as the products of combustion from burner 75 travel towards axial end plate 67.

In accordance with the invention, because axial end plate 67 and burner plate 68 block the flow of products of combustion emanating from burner 75, the products of combustion are forced through aperture "A" into heat transfer passageway 72 and from heat transfer passageway 72 through openings 61 into exhaust passageway 70 from which the exhaust gases exit to the surface. The diametrical distance of heat transfer passageway 72 is maintained very small such that (correlated to the size and spacing of aperture "A" and opening "O") only the velocity of the products of combustion within heat transfer passageway is at a Reynolds number whereat only laminar flow exists. It can be shown that at a very close spacing between plates, a laminar flow therebetween will exhibit a higher convective heat transfer coefficient than that produced by turbulent flow.

Thus, burner 75 will heat inner tube 62 in a manner which will vary as a gradient along the length of inner tube 62. Inner tube 62 in tube will radiate the heat as a gradient to outer tube 61 which in turn will similarly radiate the heat to heat transfer tube 60. If nothing more was considered, heat transfer tube 60 would have the same temperature gradient as inner tube 62. However, outer tube 61 is also being heated, and very effectively so, by the laminar flow of the products of combustion in heat transfer passageway 72 and this flow, because of the sizing of opening "O" and aperture "A" is establishing a convective heat transfer gradient along the length of outer tube 61 which is opposite to that of the temperature gradient on inner tube 62. The heat thus radiated to heat transfer tube 60 from heat transfer tube 61 is uniform. Further, this radiated heat vis-a-vis the laminar flow convective heat transfer is boosted or additive so that the "hot spot" is uniformly transmitted along the length of the tube thus making immersion radiant heat burner 30 ideal for high temperature or high heat transfer applications.

The preferred embodiment of radiant tube 30 is shown in FIGS. 5, 6, 7, 8 and 9 and reference numerals used in describing the alternative embodiment illustrated in FIGS. 1–4 will be used, where applicable, in describing radiant tube 30 of the preferred embodiment.

Referring first to FIGS. 5 and 6, radiant tube 30 includes a cylindrical heat transfer tube 60 which is contemplated to be formed of 306 or 310 stainless steel. Heat transfer tube 60 radiates heat to the work whether the work is ferrous or nonferrous metal or oil in a recovery reservoir. Concentrically disposed within heat transfer tube 60 is an outer tube 61 and concentrically disposed within outer tube 61 and closely spaced thereto is inner tube 62. That is, the outside diameter of inner tube 62 is very close to the inside diameter of outer tube 61. For example, for a 6" O.D. outer tube 61 (⅛" wall thickness) and a 5½" O.D. inner tube 62 the radial distance of annular heat transfer passageway 72 would be ¼". While inner and outer tubes 62, 61 could be constructed of a heat resistant steel such as 310 stainless steel, it is specifically contemplated, for high temperature applications, that inner and outer tubes 61, 62 could be ceramic such as silicon carbide tubes which are conventionally available in the heat treat furnace art.

As best shown in FIG. 5, in the preferred embodiment the axial or longitudinal end of heat transfer tube 60 which is remote from burner 75 is closed by a heat transfer tube axial end plate 80. The axial end of outer tube 61 remote from burner 75 is closed by outer tube end plate 82. A stabilizing stud 83 secured to heat transfer tube axial end plate 80 and outer tube end plate 82 provides an axial space between the axial end of outer tube 61 and the axial end of heat transfer tube 60 while functioning as a stabilizing mount for the axial ends of inner and outer tubes 62, 61. This is the preferred form of construction when radiant tube 30 is used as a down hole heater since it permits heat flux to also emanate from the very bottom of radiant tube 30. This mount arrangement would also be used in heat treating furnaces if radiant tube 30 was mounted to the furnace casing only at burner mounting plate 68. If the radiant tube application was through the furnace, then heat transfer tube axial end plate 80 could be coincidental with axial tube end plate 82 and a second burner mounting plate provided downstream thereof. Note that axial end of inner tube 62 which is remote from burner 75 need not be secured to outer tube end plate 82. Good heat transfer results have been achieved with the axial end of inner tube 62 contacting outer tube end plate 82 as shown in FIG. 4. It is simply noted that a slight axial space could exist.

As best shown in FIG. 6 inner tube 62 is secured to outer tube 61 by studs or fasteners 85 which in effect pin inner tube 62 to outer tube 61 in a concentric relationship. It should be apparent that the construction of radiant tube 30 illustrated in FIGS. 5 and 6 thus differs from that illustrated in FIGS. 1 and 4 in that the axial end of inner tube 62 closest to burner 75 is spaced from support flange 68 and thus annular heat transfer passageway 72 adjacent burner 75 is open i.e. at lines 6—6 of FIG. 5. What this is believed to do is to create from the force of the burners products of combustion a slight pressure head or resistance at the entrance end of heat transfer passageway 72 which in turn serves to prevent the products of combustion from short circuiting through heat transfer passageway 72. At the same time there is some attempt on some of the products of combustion to enter heat transfer passageway 72. This assures that flow through opening "O" closest to support flange 68 will occur.

Referring still to FIG. 6, aperture "A" and opening "O" are spaced at equal circumferentially extending increments about inner tube 62 and outer tube 61 respectively. In the preferred embodiment the circumferential spacing for both apertures and openings are equal but the relationship of the spacing is such that aperture "A" is spaced midway between openings "O". This is indicated by reference arcuate segment arrows 86, 87 struck relative to vertical centerline 89. Assuming that the circumferential spacing was 40° between adjacent aperture "A" or adjacent opening "O" then the spacing 86 of aperture "A" shown in FIG. 6 relative to centerline 89 would be 20° while the spacing 87 between opening "O" relative to centerline 89 would be 40°. This spacing is important to establish as long a length as possible between openings and orifices for laminar flow considerations and will be discussed further with reference to FIG. 9.

Figure 8:
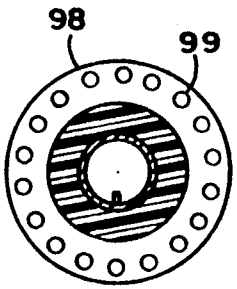
FIG. 8 is an end view of a portion of the burner assembly shown in FIG. 7.

Referring now to FIGS. 7 and 8 there is shown a particular burner arrangement which is specifically suited for radiant tube heater 30. In burner 75 a burner tube 90 aligned with axial or longitudinally-extending radiant tube centerline 65 receives a stream of gaseous fuel (conceptually could be oil droplets) from gas supply line 77 which preferably is injected under pressure as a radially expanding, right angle cone, gas jet firing in the center of burner tube 90 along longitudinal axis 65. Burner tube 90 has an entrance end 91, an exit end 92 and a tapering frusto conical section 93 which tapers radially inwardly from entrance end 91 to a point whereat a spark ignitor (conventional spark plug) 94 is placed. Circumscribing burner tube 90 is an especially configured air manifold 95 which has an air supply inlet 76 through which combustion air under predetermined pressure is supplied to air manifold 95. The air manifold 95 is provided as a fabrication about entrance end 91 of burner tube 90 so that a portion of the combustion air in air manifold 95 enters burner tube 90 as primary combustion air at entrance end 91. Stationary spacers 97 can be oriented to function as vanes or impellers which swirl primary combustion air down burner tube 90 and this swirling primary combustion air is funneled by frusto conical section 93 to ignitor 94 where a portion of the fuel and air is ignited and the ignited products of combustion travel out exit end 92 of burner tube 90. More specifically, the gas jet radially expands and contacts the inner portion of the swirling primary combustion air annulus to produce a combustible mixture which is ignited at spark ignitor 94 and continues to combust and burn while the mixture travels through burner tube out exit end 92 thereof. When the mixture leaves exit end 92 it will stabilize thereat and the flame front propagate therefrom. Air manifold 92 is configured to extend about burner tube 90 and has a closed annular end face 98 approximately coincident or slightly recessed rearwards from burner tube exit end 92. Formed in annular end face 98 is a plurality of circumferentially spaced, secondary combustion air holes 99 through which streams of secondary combustion air exhaust into central passage 73. Secondary combustion air holes 99 assure complete combustion of the fuel air mixture as the products of combustion travel down central passage 73. Depending upon flow rates, ratios etc. the shape of the flame front can be adjusted etc. Turn down is achieved by an ultraviolet cell 100 measuring combustion air temperature, pressure and/or flow rate in air manifold 75 and a thermocouple (not shown) measuring flame temperature with readings inputted into a controller shown schematically at 101 (which in practice is a sight glass) which in turn then regulates gas supply line pressure and flow 77 and combustion air temperature, pressure and flow inputted at air inlet 76 in a somewhat conventional manner. Again not only turn-down but also flame front shape or profile can be adjusted by burner 75.

Figure 9:
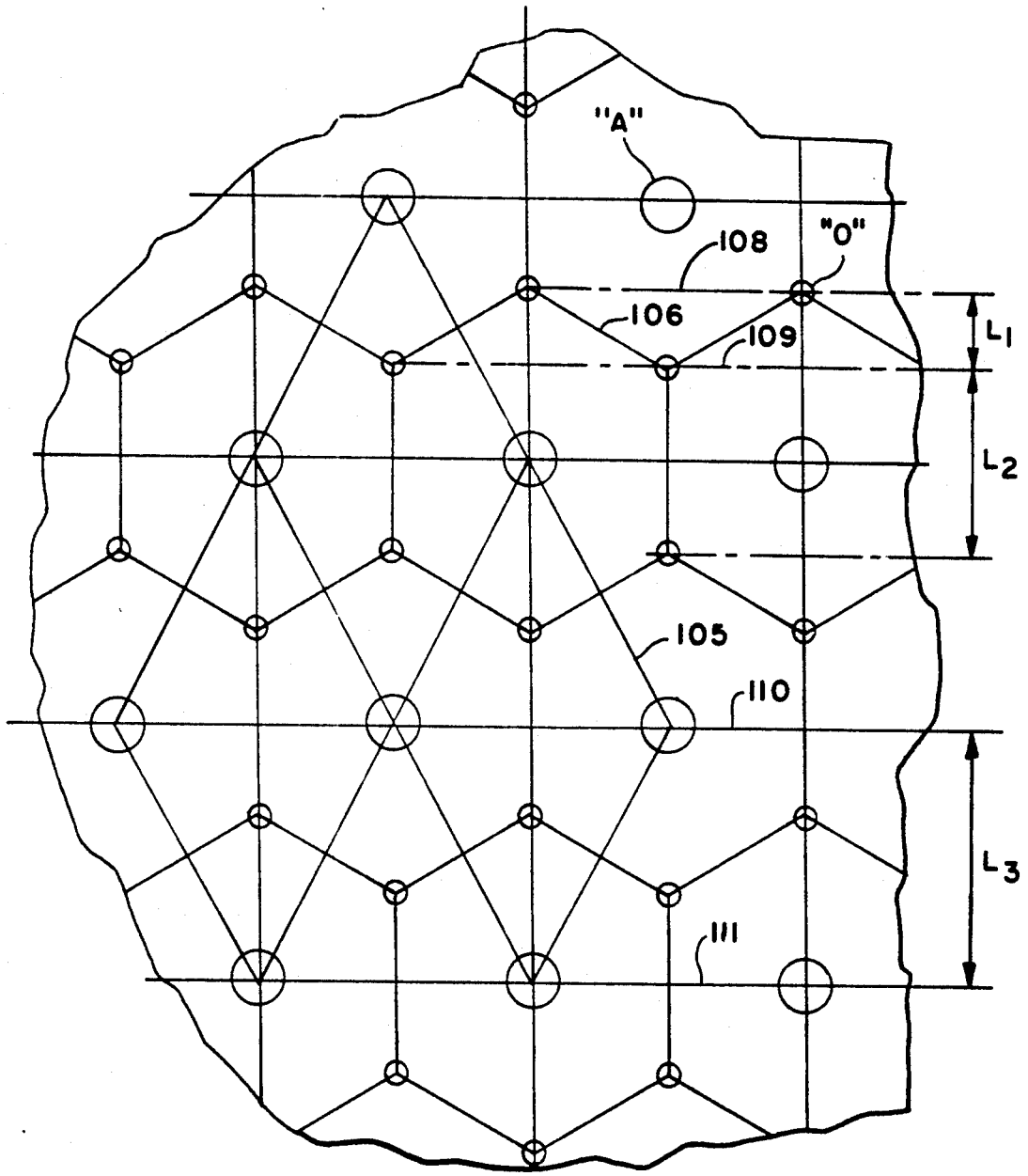
FIG. 9 is an overlay of the opening—aperture hole pattern of the preferred embodiment of the present invention.

Referring next to FIG. 9 there is shown an overlay of aperture "A" and opening "O" patterns which have been found to give the best laminar flow patterns in heat transfer passageway 72 and in turn are primarily responsible for developing a uniform heat distribution along heat transfer tubes 60 as schematically illustrated in FIG. 3. First, opening "O" in outer tube 61 is substantially larger than aperture opening "A" in inner tube 62. For the 6" O.D. outer tube 61 there is a 5½" O.D. inner tube 62. Hole diameter for opening "O" is set at about ⅜" diameter while hole diameter openings for aperture "A" are set at about 11/64" diameter. Basically it is believed for the hole patterns discussed that the diameter of opening "O" is at least three times as great as the diameter of aperture "A". As shown in FIG. 9, opening "O" is spaced to form a diamond shape 105 opening "O" pattern which circumferentially extends about outer tube 61. In contrast, aperture "A" is formed in a honeycombed pattern array 106 which circumferentially extends about inner tube 62. Now the opening "O" at each point of diamond shaped patter 105 is centered in the middle of a honeycombed aperture array 106 to give the longest flow paths to establish the desired laminar flow within heat transfer passageway 72. Another way to define this hole pattern is to state that there is a first row of aperture "A" spaced in equal increments about a circumferentially extending first centerline 108 and there is a second row of apertures equally spaced and centered on a second circumferentially extending centerline 109 with aperture "A" in the second row 109 in-between aperture "A" in the first centerline 108. Then, first and second centerlines 108, 109 are longitudinally spaced a distance L1 and regularly repeat themselves at distances L2 along the length of radiant tube 30. Opening "O" is spaced in circumferentially extending equal increments on a first centerline 110 and in equal circumferential increments on a second circumferentially extending centerline 111 with openings on first centerline 110 spaced midway between openings on second centerline 111 and with the longitudinal distance between first and second opening rows 110, 111 spaced a constant longitudinal or axial distance L3. Dimensionally, for radiant tube 30 under discussion, the distance L3 is about 2" and the distance between adjacent aperture "A" in either row 108 or row 106 is about 2.1".

The operation of the preferred embodiment is as discussed with reference to the alternative embodiment but with the additional changes and modifications which ensure the uniform heat distribution along the length of radiant tube 30. This is achieved in a constant size array or patterns of holes which regularly repeat themselves along the length of inner and outer tubes irrespective of the length of the tubes, thus materially simplifying the manufacture of the tubes. In conjunction with the hole pattern disclosed, the annular heat transfer passageway 72 is open adjacent burner 75 and thus pressurized thereby assuring the laminar flow and high convective heat transfer rates achieved by the invention. Leakage which may occur through ceramic tubes at high temperatures is not a problem in the design disclosed because heat transfer tube 60 is metal and provides the seal. Alternations and modifications will occur to others skilled in the art upon reading and understanding the specifications hereof. It is intended to include all such modifications and alterations insofar as they come within the scope of the invention.

Having thus defined the invention, it is claimed:

1. A radiant tube burner comprising:

a) burner means firing products of combustion into a generally cylindrical inner tube having a plurality of spaced apertures radially extending therethrough;

b) a concentric, closed end outer tube circumscribing said inner tube at a close radial distance to define a longitudinally-extending, small annular heat transfer passageway therebetween, said outer tube having a plurality of spaced openings radially extending therethrough;

c) a heat transfer tube having a closed end concentrically disposed about said inner tube and said outer tube for receiving heat from said outer tube and forming a second larger annulus between said heat transfer tube and said outer tube;

d) said apertures and said openings spaced with respect to each other such as to result in long axial distances between apertures in said inner tube and openings in said outer tube for any equidistant pattern of apertures and openings; and e) said apertures, said openings and the radial distance between said heat transfer tube and said outer tube being spaced and sized so that said heat transfer tube is uniformly heated by the combined action of outer and inner tube when hot burner combustion products are forced to flow from said burner means through said inner and outer tubes, through said annular space between said inner and said outer tubes, and through said second annular space between said outer tube and said heat transfer tube before returning to an exhaust in said heat transfer tube.

2. The burner of claim 1 wherein said openings in said outer tube are smaller in diameter than the diameter of said apertures in said inner tube.

3. The burner of claim 2 wherein said diameter of said apertures is at least three times greater than said diameter of said opening.

4. The burner of claim 2 wherein said diameter of each aperture is about ⅜" and said diameter of each opening is about 11/64".

5. The burner of claim 2 wherein said openings are arranged in a honeycombed pattern extending about said outer tube, said honeycombed pattern regularly repeating itself along the length of said outer tube.

6. The burner of claim 5 wherein said apertures are arranged in a diamond shaped array extending about the inner tube, said diamond shape array regularly repeating along the length of said inner tube.

7. The burner of claim 6 wherein each opening at a point in said diamond shaped array is centered in the middle of said honeycombed pattern.

8. The burner of claim 2 wherein said openings are orientated in circumferentially spaced equal increments in first and second rows which are longitudinally spaced from one another, there being a plurality of first and second rows of openings extending the length of said inner tube, each plurality of first and second row of openings spaced from one another a distance greater than the longitudinally spacing between each first and second rows of openings, and each opening in said first row being circumferentially spaced equidistant between adjacent openings in said second row whereby a honeycomb opening pattern extends around said outer tube.

9. The burner of claim 8 wherein said apertures are orientated in circumferentially equal spaced increments in first and second rows which rows are spaced in longitudinally equal increments from one another, each aperture in said first row being circumferentially spaced in equal increments between adjacent apertures in said second row whereby a diamond shaped aperture array extending around said inner tube is produced.

10. The burner of claim 9 wherein each aperture is spaced in the center of said honeycomb pattern.

11. The burner of claim 1 wherein said inner tube has a burner axial end and a remote axial end, said outer tube has a burner axial end and a remote axial end, said remote axial end of said inner tube extending longitudinally a distance not greater than the longitudinal distance of said remote axial end of said outer tube, and a plate closing said remote axial end of said outer tube whereby said annular heat transfer passageway between said inner tube and said outer tube is open at said burner axial end of said inner and outer tube for maintaining pressure at burner axial ends causing said burner products of combustion to uniformly exit said openings along the length of said tube.

12. The burner of claim 1 wherein said outer tube has an axial end adjacent an air manifold; a burner tube within said air manifold; means to supply a gaseous fuel to said burner tube and means to supply primary combustion air from said air manifold to said burner tube, means to ignite said primary air and said gaseous fuel within said burner tube, and means associated with said air manifold to supply secondary air downstream of said burner tube to assure combustion of said ignited fuel/air mixture exiting said burner tube.

13. The burner of claim 11 wherein said air manifold means includes said air manifold having a closed, annular end plate seated about said burner tube and said annular end plate has a plurality of secondary air openings circumferentially spaced about said annular end plate for directing jet streams of secondary combustion air through said annular air openings.

14. A fuel fired radiant tube burner comprising:

a) a first generally cylindrical heat transfer tube;

b) a second cylindrical outer tube concentrically disposed within said heat transfer tube and defining a longitudinally-extending annular exhaust gas passageway therebetween;

c) a third cylindrical inner tube concentrically disposed within said second tube and defining a longitudinally-extending annular heat transfer passageway therebetween;

d) burner means firing into said third tube for igniting, combusting and burning a source of fuel and air to form heated products of combustion;

e) plate means closing axial end openings of said first and third tubes which are adjacent one another; and f) aperture means associated with said inner tube and opening means associated with said outer tube overlying one another in a hole pattern which produces long distances therebetween whereby said heat transfer tube is uniformly heated along its length.

15. The burner of claim 14 wherein said openings are arranged in a honeycombed pattern extending about said outer tube, said honeycombed pattern regularly repeating itself along the length of said outer tube.

16. The burner of claim 15 wherein said apertures are arranged in a diamond shaped array extending about the inner tube, said diamond shape array regularly repeating along the length of said inner tube.

17. The burner of claim 16 wherein each opening at a point in said diamond shaped array is centered in the middle of said honeycombed pattern.

18. The burner of claim 14 wherein said openings are orientated in circumferentially spaced equal increments in first and second rows which are longitudinally spaced from one another, there being a plurality of first and second rows of openings extending the length of said inner tube, each plurality of first and second row of openings spaced from one another a distance greater than the longitudinally spacing between each first and second rows of openings, and each opening in said first row being circumferentially spaced equidistant between adjacent openings in said second row whereby a honeycomb opening pattern extends around said outer tube.

19. The burner of claim 18 wherein said apertures are orientated in circumferentially equal spaced increments in first and second rows which rows are spaced in longitudinally equal increments from one another, each aperture in said first row being circumferentially spaced in equal increments between adjacent apertures in said second row whereby a diamond shaped aperture array extending around said inner tube is produced.

20. The burner of claim 16 wherein said openings in said outer tube are smaller in diameter than the diameter of said apertures in said inner tube.

21. The burner of claim 14 wherein each opening at a point in said diamond shaped array is centered in the middle of said honeycombed pattern.

22. The burner of claim 14 wherein said inner tube has a burner axial end and a remote axial end, said outer tube has a burner axial end and a remote axial end, said remote axial end of said inner tube extending longitudinally a distance not greater than the longitudinal distance of said remote axial end of said outer tube, and a plate closing said remote axial end of said outer tube whereby said annular heat transfer passageway between said inner tube and said outer tube is open at said burner axial end of said inner and outer tube for maintaining pressure at burner axial ends causing said burner products of combustion to uniformly exit said openings along the length of said tube.

23. The burner of claim 14 wherein said inner and outer tubes are ceramic.

24. The burner of claim 23 wherein said heat transfer tube is stainless steel.

* * * * *